United States Patent [19]

Chang

[11] Patent Number: 4,816,084

[45] **Date of Patent: * Mar. 28, 1989**

[54] METHOD OF FORMING FATIGUE CRACK RESISTANT NICKEL BASE SUPERALLOYS

[75] Inventor: Keh-Minn Chang, Schenectady, N.Y.

[73] Assignee: General Electric Company, Schenectady, N.Y.

[ * ] Notice: The portion of the term of this patent subsequent to Aug. 11, 2004 has been disclaimed.

[21] Appl. No.: 907,550

[22] Filed: Sep. 15, 1986

[51] Int. Cl.[4] ..... C22F 1/10

[52] U.S. Cl. ..... 148/13; 148/162

[58] Field of Search ..... 148/162, 13, 128, 3, 148/410

[56] References Cited

U.S. PATENT DOCUMENTS 4,685,977 8/1987 Chang ..... 148/410

*Primary Examiner*—R. Dean

*Attorney, Agent, or Firm*—Paul E. Rochford; James C. Davis, Jr.; James Magee, Jr.

[57] ABSTRACT

A method is provided for reducing fatigue crack propagation in nickel base superalloys. The method involves a supersolvus anneal in which essentially all $\gamma'$ precipitate phase is dissolved. The supersolvus anneal is folloed by slow cooling which is at a rate which substantially reduces time dependent fatigue crack growth but which preserves the strength of the alloy at a useful level for many superalloy applications.

6 Claims, 10 Drawing Sheets

METHOD OF FORMING FATIGUE CRACK RESISTANT NICKEL BASE SUPERALLOYS

RELATED APPLICATIONS

The subject application relates generally to three other commonly assigned applications filed simultaneously herewith, the texts of which are included herein by reference. The related applications are as follows: Application Ser. No. 907276 (RD-17,253) filed 9/15/86; Application Ser. No. 907271 (RD-16,103) filed 9/15/86; and Application Ser. No. 907275 (RD-17,469) filed 9/15/86.

The subject application also relates generally to the subject matter of application Ser. No. 677,449, filed Dec. 3, 1984 U.S. Pat. No. 4,685,977 which application is also assigned to the same assignee as the subject application herein. The text of the related application is incorporated herein by reference.

BACKGROUND OF THE INVENTION

It is well known that nickel based superalloys are extensively employed in high performance environments. Such alloys have been used extensively in jet engines and in gas turbines where they must retain high strength and other desirable physical properties at elevated temperatures of 1000° F. or more.

For most such alloys the attainment of such a combination of properties is at least partly due to the presence therein of a $\gamma'$ precipitate or a $\gamma''$ precipitate sometimes referred to as strengthening precipitates.

More detailed characteristics of the phase chemistry of precipitate phases are given in "Phase Chemistries in Precipitation-Strengthening Superalloy" by E. L. Hall, Y. M. Kouh, and K. M. Chang [Proceedings of 41st. Annual Meeting of Electron Microscopy Society of America, Aug. 1983 (p. 248)].

The following U.S. patents disclose various nickel-base alloy compositions: U.S. Pat Nos. 2,570,193; 2,621,122; 3,046,108; 3,061,426; 3,151,981; 3,166,412; 3,322,534; 3,343,950; 3,575,734; 3,576,681; 4,207,098 and 4,336,312. The aforementioned patents are representative of the many alloying situations reported to date in which many of the same elements are combined to achieve distinctly different functional relationships between the elements such that phases providing the alloy system with different physical and mechanical characteristics are formed. Nevertheless, despite the large amount of data available concerning the nickel-base alloys, it is still not possible for workers in the art to predict with any degree of accuracy the physical and mechanical properties that will be displayed by certain concentrations of known elements used in combination to form such alloys even though such combination may fall within broad, generalized teachings in the art, particularly when the alloys are processed using heat treatments different from those previously employed.

A problem which has been recognized to a greater and greater degree with many such nickel-base superalloys is that they are subject to formation of cracks or incipient cracks, either in fabrication or in use, and that the cracks can actually propagate or grow while under stress as during use of the alloys in such structures as gas turbines and jet engines. The propagation or enlargement of cracks can lead to fracture of parts formed of such superalloys or other failure. The consequence of the failure of the moving mechanical part due to crack formation and propagation is well understood. In jet engines it can be particularly hazardous and even catastrophic.

However, what has been poorly understood until recent studies were conducted was that the formation and the propagation of cracks in structures formed of superalloys is not a monolithic phenomena in which all cracks are formed and propagated by the same mechanism and at the same rate according to the same criteria. By contrast the complexity of the crack generation and propagation and of the crack phenomena generally and the interrelation of such propagation with the manner in which stress is applied is a subject on which important new information has been gathered in recent years. The period during which stress is applied to a member to initiate or to propagate a crack, the intensity of the stress applied, the rate of application and of removal of stress to and from the member, and the schedule of this application, was not well understood in the industry until a study was conducted under contract to the National Aeronautics and Space Administration. This study is reported to a technical report identified as NASA CR165123 issued from the National Aeronautics and Space Administration in Aug. 1980 and identified as "Evaluation of the Cyclic Behavior of Aircraft Turbine Disk Alloys" Part II, Final Report, by B.A. Cowles, J.R. Warren and F.K. Hauke, prepared for the National Aeronautics and Space Administration, NASA Lewis Research Center Contrast NAS3-21379.

A principal unique finding of the NASA sponsored study was that the rate of propagation based on fatigue phenomena or in other words the rate of fatigue crack propagation (FCP) was not uniform for all stresses applied nor to all manners of applications of stress. More importantly, the finding was that fatigue crack propagation actually varied with the frequency of the application of stress to the member where the stress was applied in a manner to enlarge the crack. More surprising still, was the finding from the NASA sponsored study that the application of stress of lower frequencies rather than at the higher frequencies previously employed in studies actually increased the rate of crack propagation. In other words the NASA study revealed that there was a time dependence in fatigue crack propagation. Further the time dependence of fatigue crack propagation was found to depend not on frequency alone but also on the time during which a member was held under stress or a so-called hold time. Following the discovery of this unusual and unexpected phenomena of increased fatigue crack propagation and lower stress frequencies there was some belief in the industry that this newly discovered phenomena represented an ultimate limitation on the ability of the nickel based superalloys to be employed in the stress bearing parts of the turbines and aircraft engines and that all design effort had to be directed to design around this problem.

However, it has now been discovered that it is feasible to construct parts of nickel based superalloys for use at high stress in turbines and aircraft engines with greatly reduced crack propagation rates.

The development of new superalloy processing and compositions has now focused on the fatigue property and has addressed in particular the time dependence of crack growth.

Crack growth, i.e., the crack propagation rate, in high-strength alloy bodies is known to depend upon the applied stress ($\sigma$) as well as the crack length (a). These two factors are combined by fracture mechanics to form one single crack growth driving force; namely, stress intensity K, which is proportional to $\sigma\sqrt{a}$. Under the fatigue condition, the stress intensity in a fatigue cycle represents the maximum variation of cyclic stress intensity ($\Delta K$), i.e., the difference between $K_{max}$ and $K_{min}$. At moderate temperatures, crack growth is determined primarily by the cyclic stress intensity ($\Delta K$) until the static fracture toughness $K_{IC}$ is reached. Crack growth rate is expressed mathematically as $da/dN \propto (\Delta K)^n$. N represents the number of cycles and n is a constant, which is between 2 and 4. The cyclic frequency and the shape of the waveform are the important parameters determining the crack growth rate. For a given cyclic stress intensity, a slower cyclic frequency can result in a faster crack growth rate. This undesirable time-dependent behavior of fatigue crack propagation can occur in most existing high strength superalloys.

The most undesirable time-dependent crack-growth behavior has been found to occur when a hold time is superimposed on a sine wave variation in stress. In such case a test sample may be subjected to stress in a sine wave pattern but when the sample is at maximum stress the stress is held constant for a hold time. When the hold time is completed the sine wave application of stress is resumed. According to this hold time pattern the stress is held for a designated hold time each time the stress reaches a maximum in following the normal sine curve. This hold time pattern of application of stress is a separate criteria for studying crack growth. This type of hold time pattern was used in the NASA study referred to above.

A main design objective is to make the value of da/dN as small and as free of time dependency as possible.

BRIEF DESCRIPTION OF THE INVENTION

It is, accordingly, one object of the present invention to provide a method for forming nickel-base superalloy products which are more resistant to cracking.

Another object is to provide a method for reducing the tendency of nickel-base superalloys to undergo time dependent cracking.

Another object is to provide a method to modify nickel-base superalloy articles for use under high stress which are more resistant to fatigue crack propagation.

Another object is to provide a method which permits nickel-base superalloys to have imparted thereto resistance to cracking under stress which is applied cyclically over a range of frequencies and with a hold time.

Other objects will be in part apparent and in part pointed out in the description which follows.

In one of its broader aspects, objects of the invention can be achieved by subjecting nickel-base superalloys subject to fatigue crack propagation to thermal processing.

A heat treatment method has been discovered which improves a superalloy's resistance to fatigue crack growth when subjected to stress under time dependent conditions. The method is effective in improving the properties of a variety of superalloys which contain $\gamma'$ precipitate phase and on a number of different and distinct forms of such superalloy including conventional cast and/or wrought alloy and advanced spray formed or powder metallurgy formed alloy.

This thermal treatment involves a high temperature solutioning and a controlled cooling from the solution temperature. The solution temperature used in practice of the method is above the precipitate solvus, and the cooling rate after solutioning should be within a range as specified below. Subsequent aging treatments to develop alloy strength can be carried out after the controlled cooling.

The method has application to all high strength superalloys containing a volume fraction of $\gamma'$ precipitate in excess of 35%.

This method contrasts dramatically with prior art practice although there is a deceptively close similarity in the steps and combination of steps which are used in this invention in comparison to the combination of steps employed by prior art practices. Prior art superalloys containing high volume concentrations of $\gamma'$ precipitate had been annealed and subsequently cooled and aged. According to prior practice so-called solution annealing had been carried out below the solvus temperature. At a temperature below the solvus temperature any $\gamma'$ precipitate present is at most only partially dissolved and never fully dissolved. Thus although the prior art annealing was referred to as solution annealing it was drastically different from the practice of the present invention because the so-called solution annealing was carried out below the temperature at which the $\gamma'$ precipitate is fully redissolved into the superalloy matrix.

By contrast the present invention requires a solution anneal at a temperature above the $\gamma'$ solvus temperature and requires a full dissolution of any $\gamma'$ precipitate present. Only if the anneal is done above the $\gamma'$ solvus temperature and below the incipient melting temperature of the superalloy itself are the results taught here achievable.

The prior art practice has used a so called solution annealing but, although termed "solution annealing", the annealing did not completely dissolve the $\gamma'$ precipitate but was instead carried out at temperatures below the $\gamma'$ solvus temperature (subsolvus annealing) to partially dissolve the $\gamma'$ precipitate only and to maintain a high strength and a fine grain structure of prior art superalloy compositions. Also according to prior art practice it was known that the alloy strength could be improved if the cooling rate following the subsolvus annealing was increased.

In dramatic contrast the teaching of the present invention is that the rate of cooling after supersolvus annealing should be decreased.

The beneficial effects of these at least two critical changes of the present invention (supersolvus anneal and slow cooling) from prior practice (subsolvus anneal and fast cooling) are explained from the examples and description below.

BRIEF DESCRIPTION OF THE DRAWINGS

The features of this invention believed to be novel and unobvious over the prior art are set forth with particularity in the appended claims. The invention itself, however, as to organization, method of operation and objects and advantages thereof may best be understood by reference to the following description taken in conjunction with the accompanying drawings wherein:

DETAILED DESCRIPTION OF THE INVENTION

Figure 1:
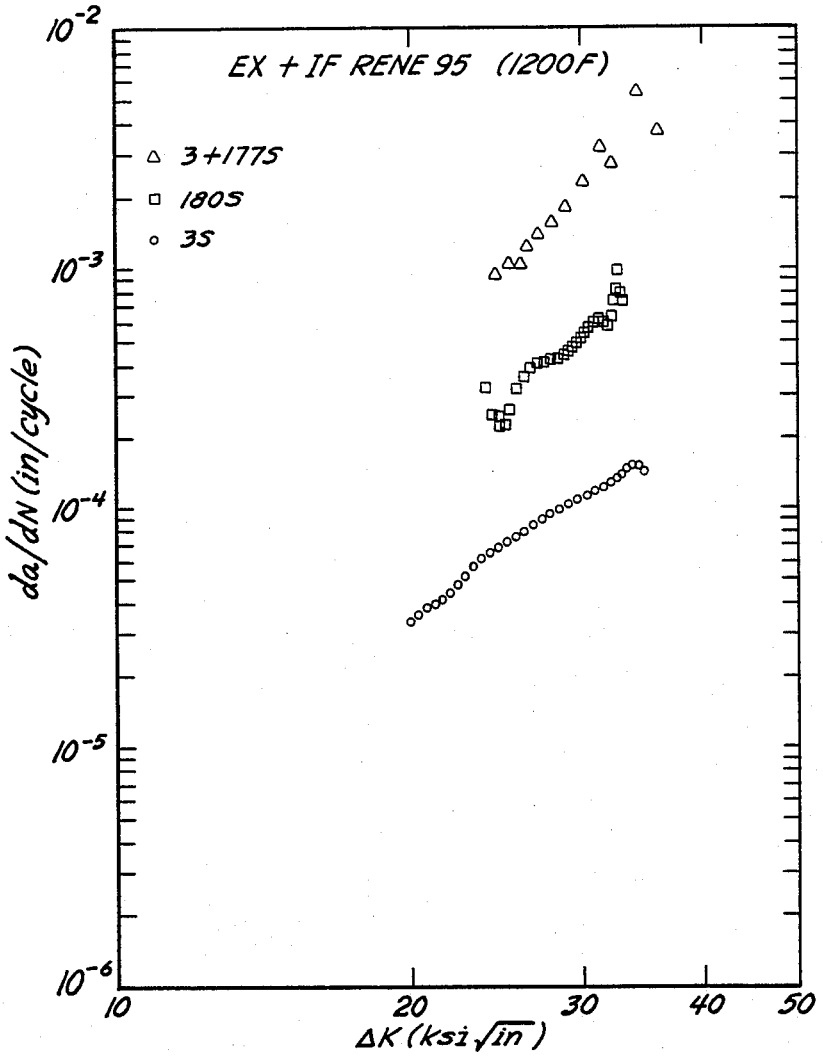
FIGS. 1–10 are graphic (log-log plots) representations of fatigue crack growth rates (da/dN) in inches per cycle obtained at various stress intensities ($\Delta K$ in ksi $\sqrt{in}$) for a number of different alloy compositions at a number of different temperatures and different cooling rates where the fatigue crack growth rate studies are done under cyclic applications of stress at a series of frequencies as is now conventionally employed in the industry and one of which cyclic stress applications includes a hold at maximum stress intensity.

Low cycle fatigue life is considered to be a limiting factor for the components of turbine engines and jet engines which are subject to rotary motion or similar periodic or cyclic high stress.

Progress has been made in forming superalloy metal compositions containing high volume percents of strengthening precipitates and in processing of these metals into parts for advanced turbine engines and jet aircraft engines. This metal processing technology has been developed to introduce such superalloys into gas turbines and jet engines because of the higher temperature capabilities of the alloys themselves and because the engines built with such alloys also have higher temperature capabilities and resulting higher efficiencies and thrust per unit weight of engine. While some studies such as the NASA studies described above have been made of a number of these alloys, not all of the alloys have been examined comprehensively with respect to fatigue cracking and with respect to resistance to fatigue cracking.

It has been determined that at low temperatures the fatigue crack propagation depends essentially entirely on the intensity at which stress is applied to components and parts of such structures in a cyclic fashion. As is partially explained in the background statement above, the crack growth rate at elevated temperatures cannot be determined simply as a function of the applied cyclic stress intensity $\Delta K$. Rather the fatigue frequency can also affect the propagation rate. The NASA study demonstrated that the slower the cyclic frequency is the faster the crack grows per unit cycle of applied stress. It has also been observed that faster crack propagation occurs when a hold time is applied during the fatigue cycle. Time-dependence is a term which is applied to such cracking behavior at elevated temperatures where the fatigue frequency and hold time are significant parameters.

EXAMPLE 1

A sample of an alloy member which is commercially available and sold under the designation Rene' 95 was obtained to demonstrate the time dependence of fatigue crack propagation as discussed above. The alloy sample had been prepared by powder metallurgy techniques. Rene' 95 is known to be the strongest of the nickel based superalloys which is commercially available. The sample was heated to 1200° F. and fatigue crack growth rate was measured. Three tests were performed and a different cyclic application of stress to the sample was used in each of the three tests. Cyclic stress was applied to the first sample in three second sinusoidal cycles. In the second sample the cyclic waveform was a 180 second sinusoidal cycle. The third mode of application of stress was a three second sinusoidal cycle which was interrupted by a 177 second hold at the maximum stress. These cyclic tests are similar to those employed in the NASA study.

The ratio of the minimum load to the maximum load was set at 0.05 so that maximum load was 20X greater than the minimum load. The results of the study were obtained and are plotted in FIG. 1.

As is evident from FIG. 1 the crack growth rate increases by a factor of five when the fatigue cycle is changed from three seconds to 180 seconds. When the sample is processed through the hold time cycle the crack growth rate is accelerated by a factor of 20 over the rate which is found for crack growth rate at the three second fatigue cycle.

This example demonstrates that there is a very significant effect on the fatigue crack propagation rate which is related both to the change in the cycle at which stress is applied and also to the hold time which is imposed on one of the cycles of stress application.

Pursuant to the present invention the time dependence of fatigue crack propagation is reduced and minimized through a combination of steps which involve heat treatment to the conventional alloys to convert them to a form which has greater resistance to fatigue crack propagation. In other words a conventional commercially available alloy may be selected and then subjected to a number of steps as described below and its susceptibility to fatigue crack propagation is remarkably and reliably reduced to levels where the growth of the crack in inches per cycle is far more uniform for each of the three different cyclic stress applications as described above. Through practice of the present invention the time dependence of fatigue crack propagation is altered so that fatigue crack propagation becomes far less dependent on time and can even become time independent.

EXAMPLES 2, 3 and 4

A number of samples of Rene' 95 superalloy prepared by powder metallurgy were obtained from commercial sources. The $\gamma'$ solvus temperature of the material was studied and was determined to be 1160° C. All of the samples were subsolvus annealed at about 1140° C. and were then cooled at different cooling rates. The first sample was cooled at 1500° F. per minute, a second sample at 400° F. per minute and a third sample at 25° F. per minute. An aging treatment was done at 760° C. for 16 hours. Fatigue crack growth rates were measured for each of these samples at 1200° F. using three fatigue waveforms as described above one of which was at three seconds, a second at 180 seconds and a third at three seconds with a 177 second hold at the maximum load of the three second sinusoidal cycle. Data was collected from the fatigue crack growth rate study and the results of the study are plotted in FIGS. 2, 3 and 4, respectively, for the samples coded at the three different rates respectively as described above. It can be observed from a study of and a comparison of the results plotted on the graphs of FIGS. 2, 3 and 4 that the time dependent crack growth resistance improves as the cooling rate of the samples is decreased but that the improvement is quite limited.

EXAMPLES 5, 6 and 7

Three additional samples of the Rene' 95 which had been obtained from the same commercial sources and which had been prepared by powder metallurgy techniques were annealed at a supersolvus temperature (i.e. above the $\gamma'$ solvus) of 1175° C. Following the supersolvus anneal, the samples were cooled at different cooling rates of 1500° F. per minute for the sample of Example 5, 400° F. per minute for the sample of Example 6 and 150° F. per minute for the sample of Example 7. An aging treatment was done at 760° C. for 16 hours for each of the samples. Fatigue crack growth rates were measured at 1200° F. using the three fatigue waveforms as described above in Examples 2, 3 and 4. The data obtained through these studies and measurements was taken and is plotted in FIGS. 5, 6 and 7, respectively. It is readily evident from an examination of the graphs that a startling and remarkable improvement in crack growth rate is observed for the sample which is cooled at the lowest rate as compared particularly to the sample cooled at the highest rate.

Figure 2:
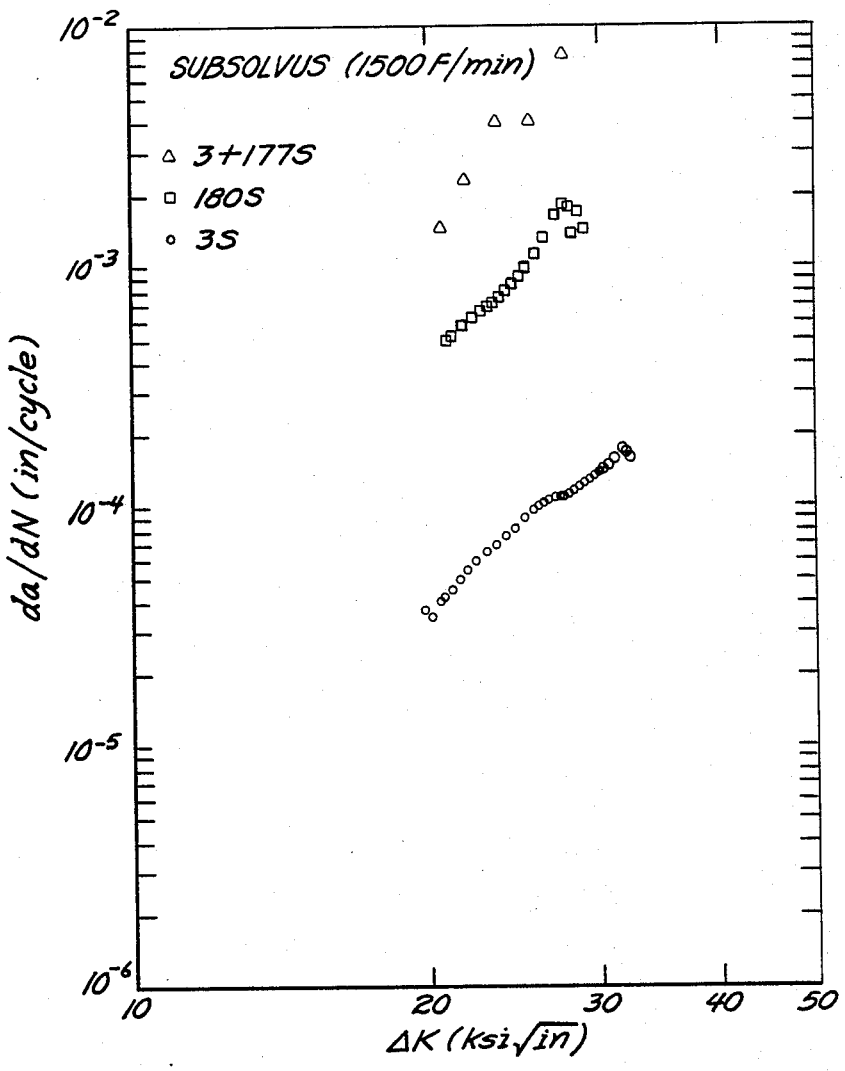
Figure 3:
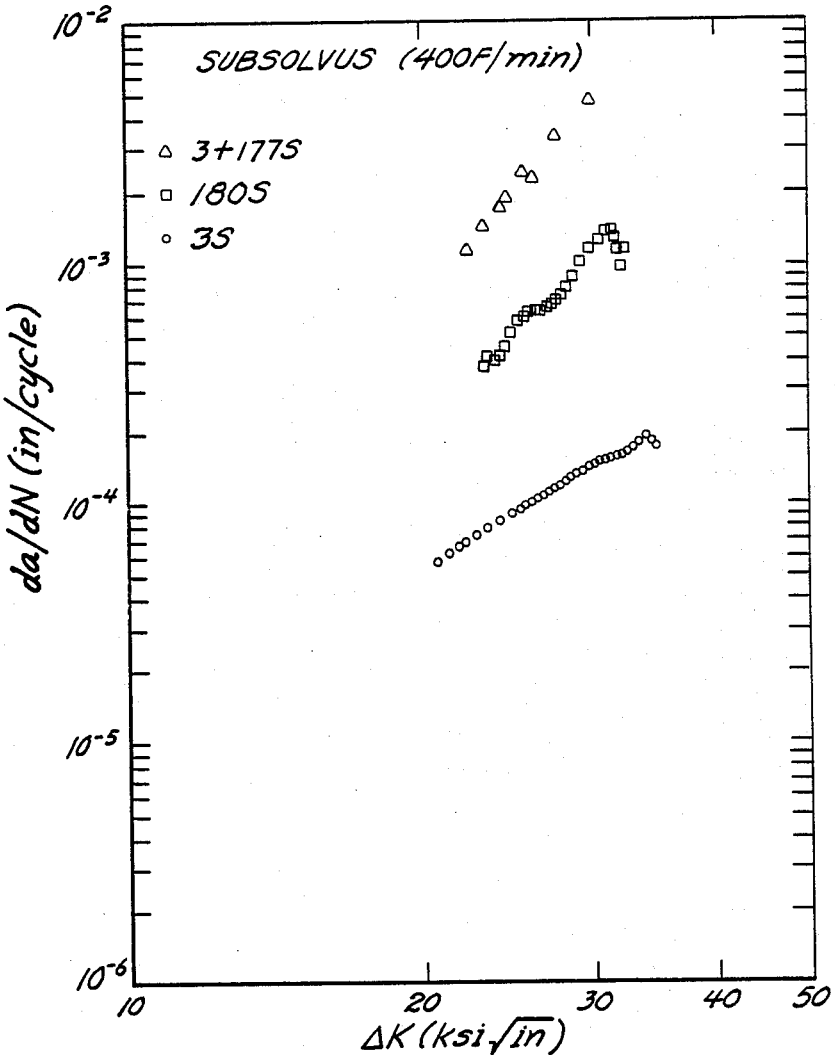
Figure 4:
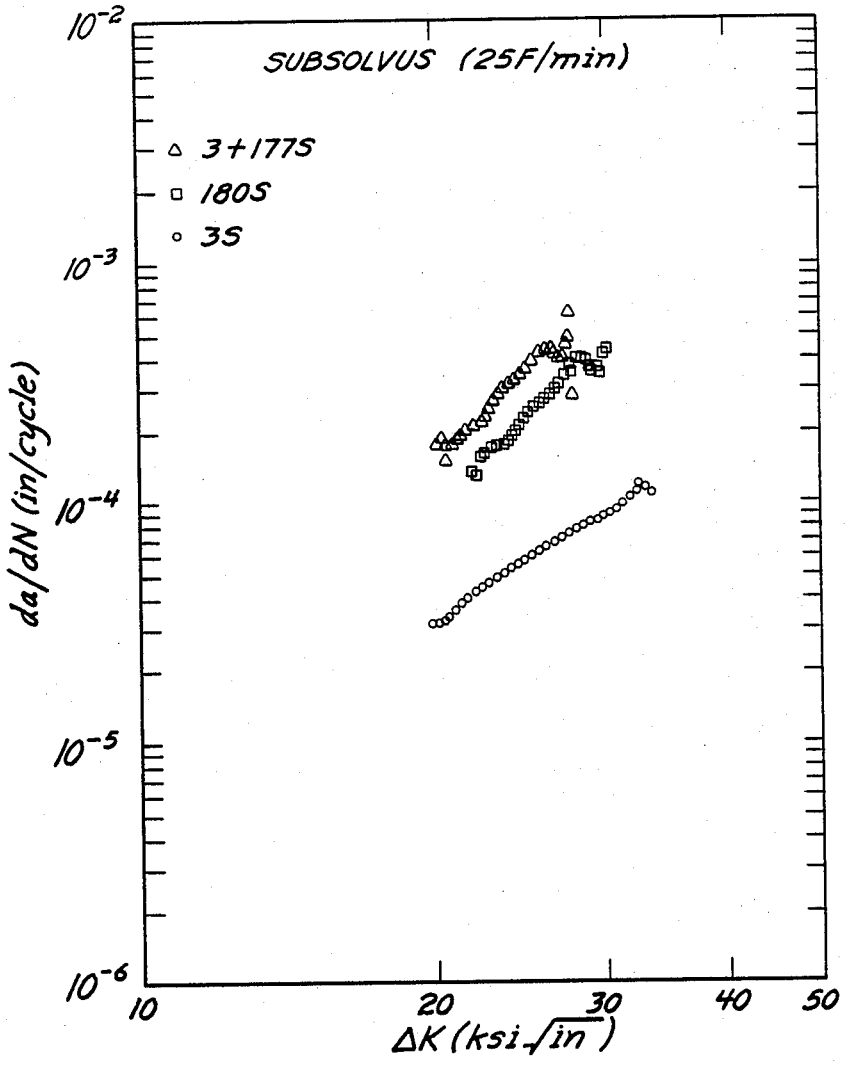
Figure 5:
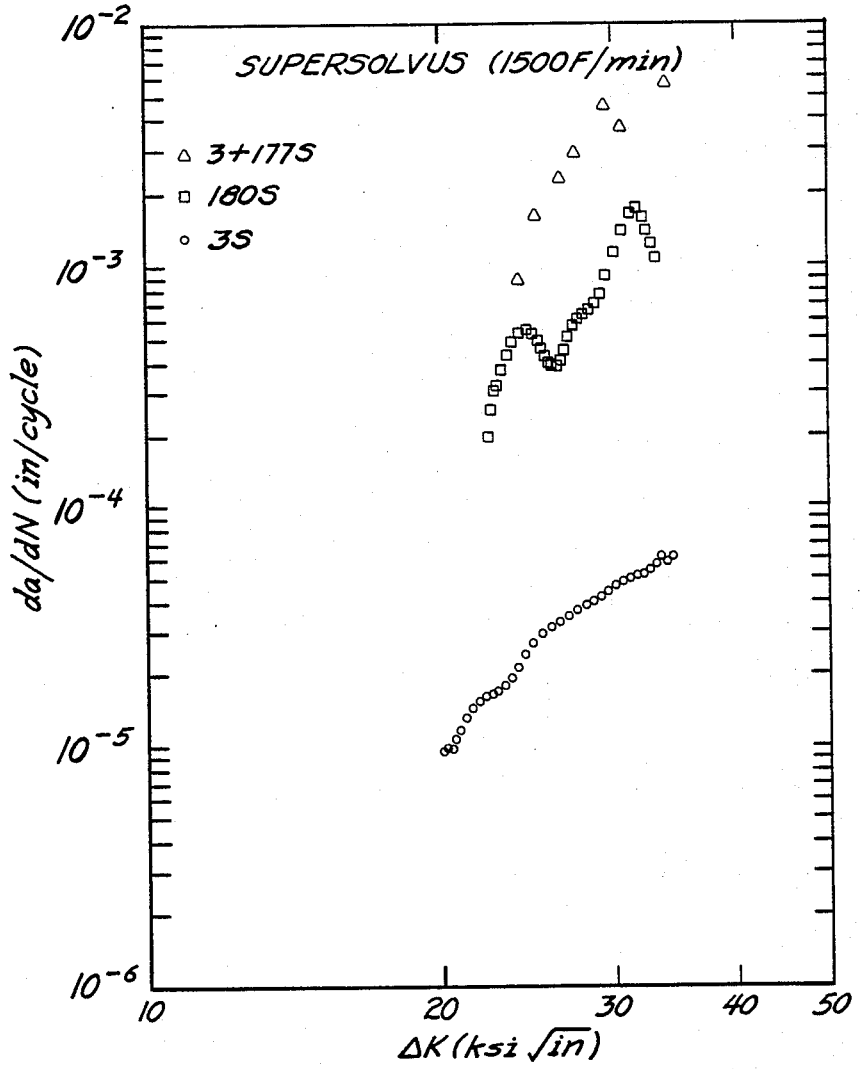
Figure 6:
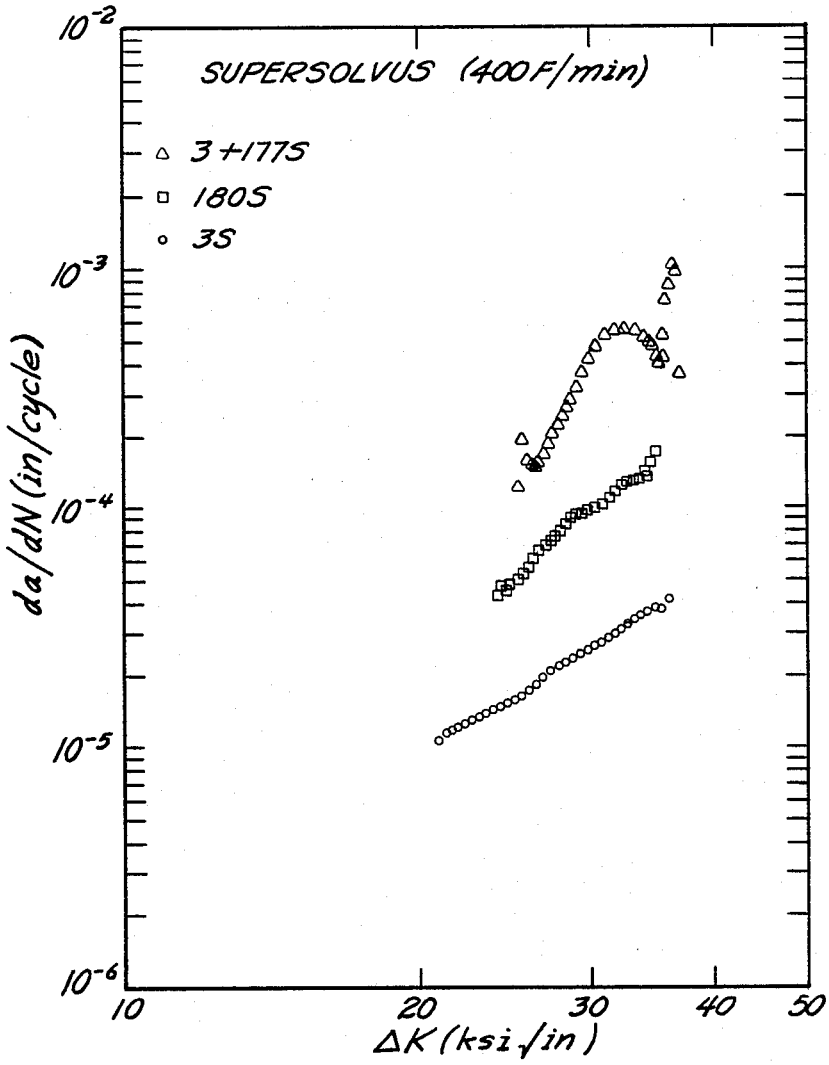
Figure 7:
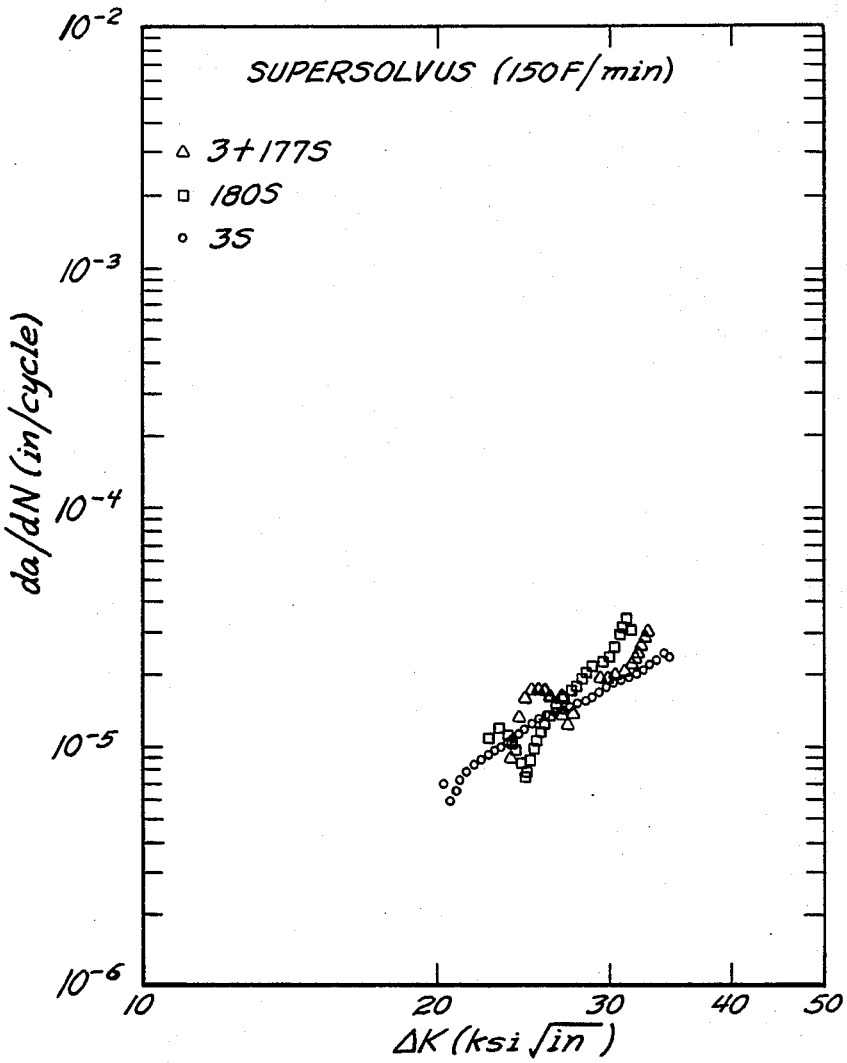

It is also readily evident by comparison of the data plotted in FIGS. 2, 3 and 4 with that plotted in FIGS. 5, 6 and 7 that the absolute value of crack growth rate is decreased in comparison with the rate observed for the subsolvus annealed samples.

What is also quite remarkable is the finding that with reference to the data plotted in FIGS. 5, 6 and 7, the degree of time-dependence, i.e., the increment of crack growth rate with frequency and/or hold time, is reduced dramatically.

EXAMPLES 8 and 9

The invention was practiced on two more commercially available alloys. In Example 8 the alloy was low carbon Astroloy and in Example 9 the alloy is IN-100. The chemical compositions of these alloys are shown in Table I:

TABLE I

| Element | Chemical Composition. Rene 95 | Astroloy | IN 100 |
|---|---|---|---|
| Ni | bal. | bal. | bal. |
| Co | 8.0 | 17.0 | 15.0 |
| Cr | 13.0 | 15.0 | 10.0 |
| Mo | 3.5 | 5.3 | 3.0 |
| Nb | 3.5 | — | — |
| W | 3.5 | — | — |
| Al | 3.5 | 4.0 | 5.5 |
| Ti | 2.5 | 3.5 | 4.7 |
| V | — | — | 0.9 |
| Zr | 0.05 | — | 0.06 |
| B | 0.01 | 0.03 | 0.014 |
| C | 0.06 | 0.03 | 0.05 |

EXAMPLE 8

Figure 8:
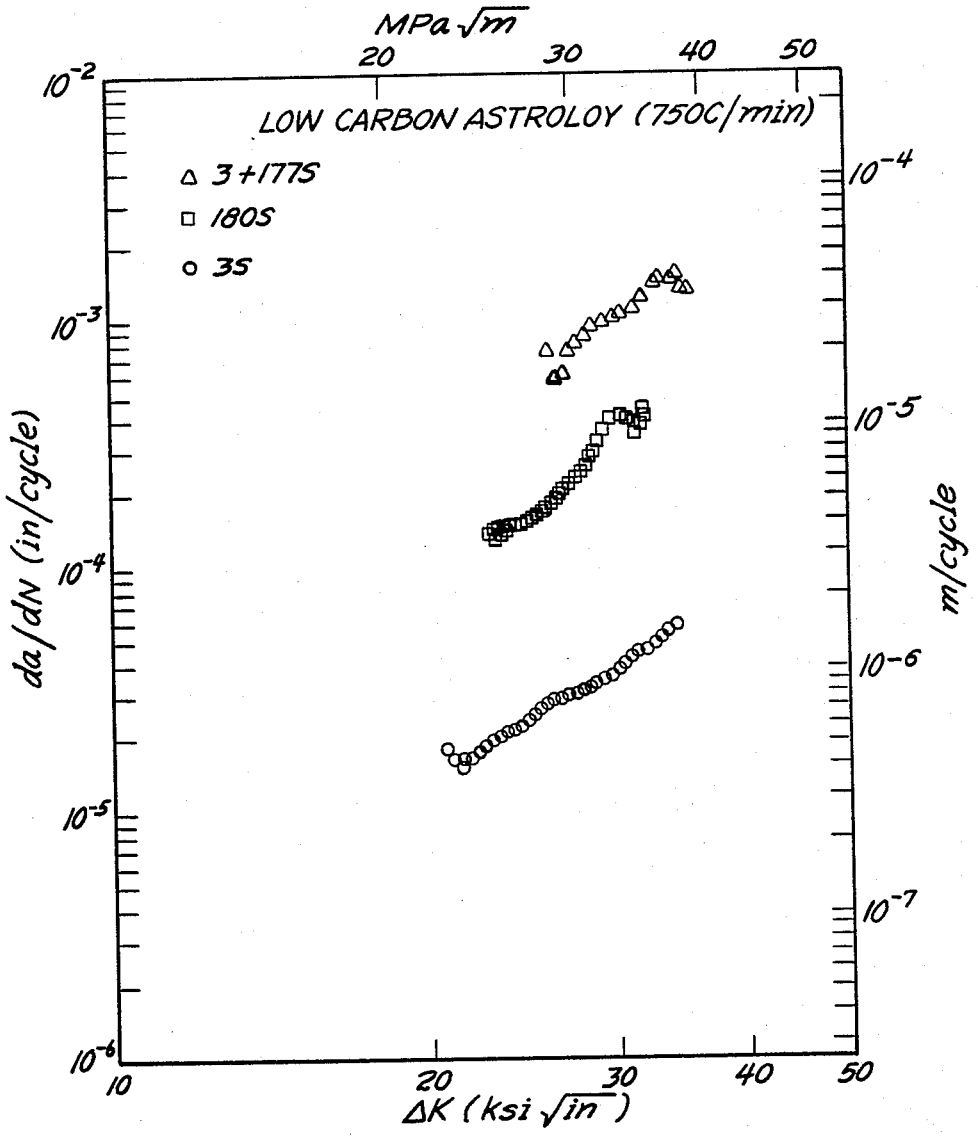
Figure 9:
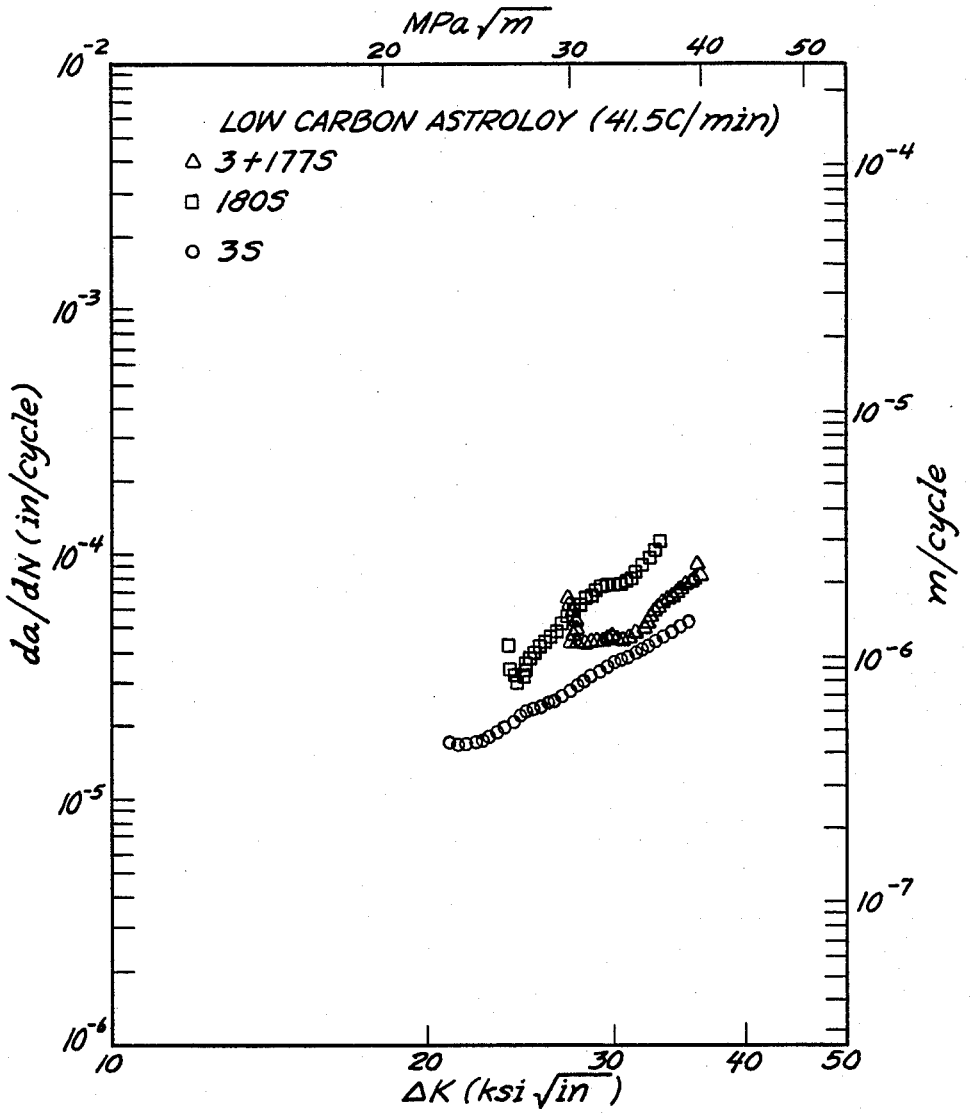

The commercially available low carbon Astroloy contained about 45 volume % of precipitates. The precipitate solvus temperature was determined to be about 2057° F. (1125° C.). The alloy was annealed at a supersolvus temperature of 2084° F. (1140° C.). Following the supersolvus annealing, different cooling rates were used to cool the alloys from solutioning temperatures. One sample of Astroloy was cooled at 1382° F. (750° C.) per minute and a second sample was cooled at a cooling rate of 107° F. (41.5° C.) per minute. FIG. 8 shows the da/dN curves for the fast cooled Astroloy sample of Example 8. Strong time-dependence of crack growth rate may be observed. However, for the sample of Astroloy which is cooled at the rate of 107° F. (41.5° C.) per minute time dependent crack growth resistance was substantially improved and this is evident from the plot of the data of FIG. 9.

EXAMPLE 9

Figure 10:
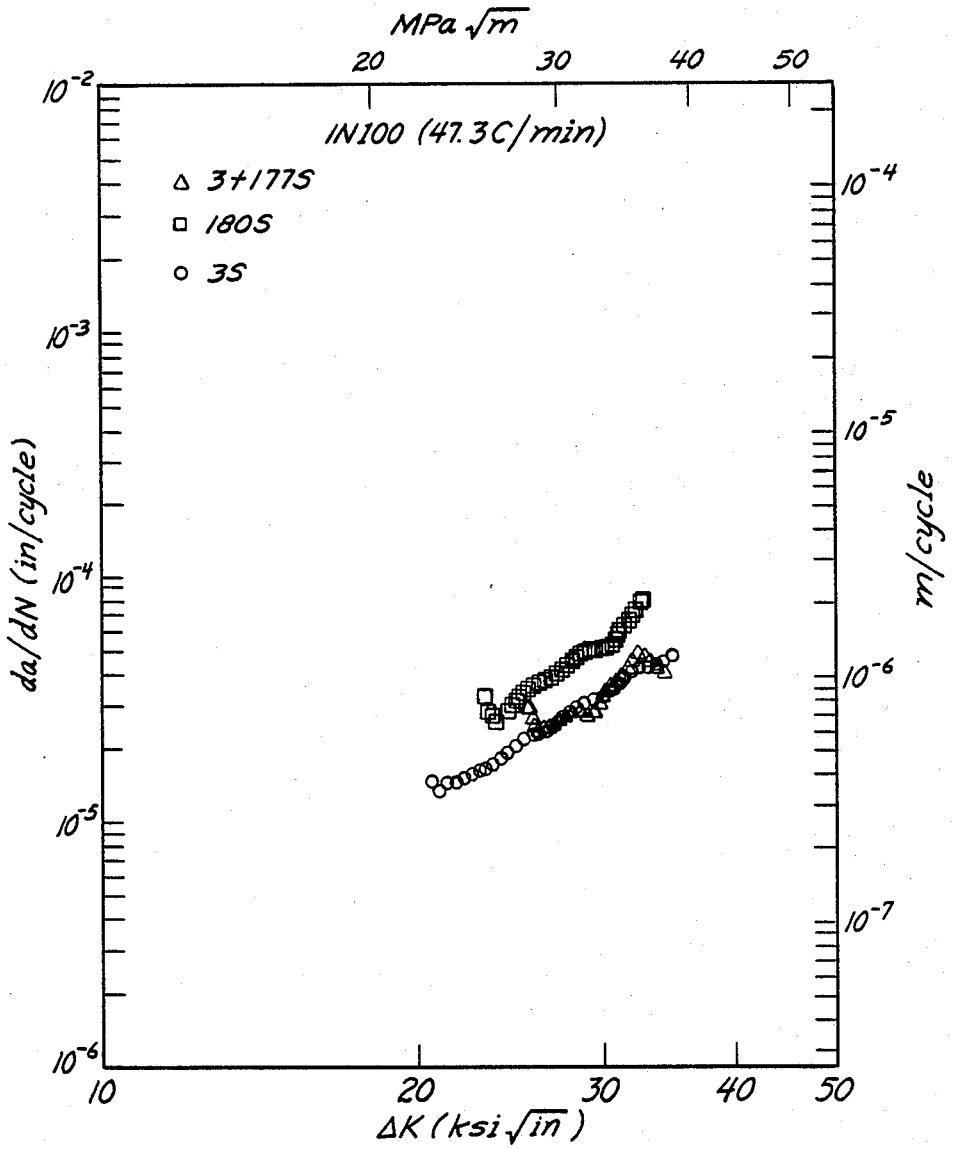

The sample of IN-100 alloy was found to have excellent resistance to time dependent crack propagation when treated according to the method of the present invention. In this example the IN-100 was heated and annealed at above the solvus temperature and the alloy was cooled at a controlled cooling rate of 117° F. (47.3° C.) per minute. The crack growth rate is measured and plotted in FIG. 10. It is obvious from the figure that the results further demonstrate the validation of the invention inasmuch as there is excellent resistance to time dependent crack propagation displayed from the data of FIG. 10.

From the foregoing examples and discussion it is clear that the heat treatment that combines a supersolvus solution annealing and a controlled cooling afterward can impart to high strength superalloys good crack growth resistance especially under time dependent conditions.

The method of this invention provides improvements in fatigue crack propagation for alloys which have a relatively high volume concentration of $\gamma'$ precipitate. For significant results $\gamma'$ volume concentration should be at least 45%.

In practicing the present invention care should be exercised in the cooling of a specimen which has been supersolvus annealed. As has been taught clearly above the rate of cooling affects the properties of the specimen relating to fatigue crack propagation and lower rates of cooling have been discovered to reduce fatigue crack propagation. At the same time it is recognized that very slow cooling rates may, depending on the alloy involved, result in lower levels of strength in the alloy. As has also been taught above aging treatments following cooling from a supersolvus anneal can be employed to enhance alloy strength.

However the rate of cooling from a supersolvus anneal can be modified, again depending on the easily determined characteristics of specific alloys, to provide a needed degree of freedom from time-dependent fatigue crack propagation and at the same time preserve much of the inherent strength of alloys on which the method of the present invention are practiced. The best balance of strength properties with inhibition of fatigue crack propagation can be determined from a few tests conducted in a manner similar to those described with respect to the above examples.

What is claimed and sought to be protected by Letters Patent of the United States is as follows:

1. The method of increasing the fatigue crack resistance of a nickel base superalloy having a $\gamma'$ strengthening precipitate and a nickel base superalloy matrix which comprises determining the solvus temperature of the precipitate as the temperature at which essentially $\gamma'$ precipitate dissolves in the superalloy matrix, supersolvus annealing the alloy at a temperature above the solvus temperature for a time to essentially completely dissolve the $\gamma'$ precipitate, and slowly cooling the alloy from the supersolvus temperature.

2. The method of claim 1 wherein after being slowly cooled the alloy is aged to improve the strength thereof.

3. The method of claim 1 wherein the superalloy has $\gamma'$ precipitate to the extent of at least 35% by volume.

4. The method of claim 1 wherein the cooling rate is less than 80° F./min.

5. The method of claim 1 in which the cooling rate is between 50 and 250° F./min.

6. The method of claim 1 in which the alloy is Rene' 95 and the cooling time is less than 150° F./min.

* * * * *